US011656573B1

(12) United States Patent
Matsumoto

(10) Patent No.: US 11,656,573 B1
(45) Date of Patent: May 23, 2023

(54) IMAGE FORMING APPARATUS

(71) Applicant: KYOCERA Document Solutions Inc., Osaka (JP)

(72) Inventor: Hiromu Matsumoto, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/995,789

(22) PCT Filed: Mar. 4, 2021

(86) PCT No.: PCT/JP2021/008523

§ 371 (c)(1),
(2) Date: Oct. 7, 2022

(87) PCT Pub. No.: WO2021/205791

PCT Pub. Date: Oct. 14, 2021

(30) Foreign Application Priority Data

Apr. 8, 2020 (JP) ..... JP2020-069780

(51) Int. Cl.
*G03G 21/16* (2006.01)
*G03G 15/08* (2006.01)

(52) U.S. Cl.
CPC ..... *G03G 21/1676* (2013.01); *G03G 15/0898* (2013.01); *G03G 21/1695* (2013.01); *G03G 2221/1648* (2013.01)

(58) Field of Classification Search
CPC ..... G03G 15/0898; G03G 21/1676; G03G 21/1695; G03G 2221/1648
See application file for complete search history.

(56) References Cited

U.S. PATENT DOCUMENTS

| | | | | |
|---|---|---|---|---|
| 10,162,299 | B2 | 12/2018 | Nakamura et al. | |
| 2017/0315493 | A1* | 11/2017 | Satake | G03G 15/6561 |
| 2019/0235440 | A1* | 8/2019 | Taguchi | G03G 21/1695 |
| 2020/0257221 | A1* | 8/2020 | Akaike | G03G 15/0898 |

FOREIGN PATENT DOCUMENTS

JP 2017-198818 A 11/2017

* cited by examiner

*Primary Examiner* — Sophia S Chen
(74) *Attorney, Agent, or Firm* — Studebaker & Brackett PC

(57) ABSTRACT

An image forming apparatus (1) includes a process unit (P) which is configured to be turned upward and then detached from an apparatus main body (3). The process unit (P) includes: a photosensitive drum (47); a developing device (51) which forms a developing nip area; a guide member (81) which comes into contact with an upper surface of a sheet and guides the sheet; and a seal member (91) supported between the developing device (51) and the guide member (81) in a turnable manner, wherein the seal member (91) opens a gap between the developing device (51) and the guide member (81) in a state where the process unit (P) is attached to the apparatus main body (3), and when the process unit (P) is turned upward, the seal member (91) is turned to close the gap between the developing device (51) and the guide member (81).

5 Claims, 7 Drawing Sheets

IMAGE FORMING APPARATUS

TECHNICAL FIELD

The present invention relates to an image forming apparatus including a guide member which guides a sheet from a photosensitive drum to a transfer nip area.

BACKGROUND

In an electrophotographic type image forming apparatus, a developing nip area is formed between a developing roller of a developing device and a photosensitive drum, and a transferring nip area is formed between a transferring roller and the photosensitive drum. An electrostatic latent image formed on the photosensitive drum is developed into a toner image at the developing nip area, and the developed toner image is transferred from the photosensitive drum to a sheet at the transferring nip area. The sheet is conveyed along a predetermined conveying direction and guided to the transferring nip area by a guide member. On the conveying path on the upstream side of the transferring nip area in the sheet conveying direction or in the vicinity of the conveying path, a developer (a toner) scattered from the developing device tends to accumulate.

Therefore, in order to prevent the toner from entering between the developing device and the guide member, a gap between the guide member and the developing device may be blocked by a blocking member such as a sponge.

On the other hand, in the image forming apparatus, a process unit in which the developing device and the photosensitive drum are unitized may be detachably supported by the apparatus main body. The process unit is detached from the apparatus main body by being turned upward around a rotation axis along the horizontal direction and then pulled out along a direction orthogonal to the rotation axis. The above-described blocking member also serves to prevent the toner accumulated on the upper surface of the guide member from falling when the process unit is turned.

In a case where the blocking member is provided, when the leading end of the sheet guided along the guide member comes into contact with the photosensitive drum, a closed space is formed by the developing device, the blocking member, the guide member, the sheet, and the photosensitive drum. When the sheet moves in accordance with the rotation of the photosensitive drum, the volume of the space changes by the amount of the movement of the sheet, and an air flow is generated in the space, and the position of the toner image formed on the photosensitive drum is shifted, resulting in the generation of image defects, such as transverse stripes.

Therefore, the guide member described in Patent document 1 is provided with a rib at the tip end portion, and a gap through the rib is formed between the conveyed sheet and the tip end portion. As a result, the change in the volume of the space can be reduced when the sheet moves in accordance with the rotation of the photosensitive drum.

PRIOR ART DOCUMENTS

Patent Documents

Japanese Unexamined Patent Application Publication No. 2017-198818

Outline of the Invention

Problems to be Solved by the Invention

However, in the guide member described in the above-described patent document, since a gap is opened between the guide member and the sheet, there is a case where an air flow flowing through the gap to the conveying path is generated. Then, there is a problem that the scattered toner flows into the conveying path by the air flow. In such a situation where the problem that occurs when the blocking member is provided is not sufficiently solved, it is preferable not to provide the blocking member so as not to form the above-described closed space. However, in the case where the blocking member is not provided, there is a problem that the toner accumulated on the upper surface of the guide member falls when the process unit is turned.

In view of the above circumstances, it is an object of the present invention to provide an image forming apparatus capable of suppressing the generation of air flow when the sheet enters the transferring nip area and preventing the toner from falling when the process unit is turned.

Means of Solving the Problems

In order to solve the above problems, an image forming apparatus according to the present invention includes a process unit which is configured to be turned upward around a turning shaft and then detached from an apparatus main body, wherein the process unit includes: a photosensitive drum rotating in a predetermined rotating direction; a developing device which faces a surface of the photosensitive drum to form a developing nip area; a guide member which comes into contact with an upper surface of a sheet and guides the sheet to a downstream side of the developing nip area in the rotating direction; and a seal member supported between the developing device and the guide member in a turnable manner, wherein the seal member opens a gap between the developing device and the guide member in a state where the process unit is attached to the apparatus main body, and when the process unit is turned upward when detached from the apparatus body, the seal member is turned to close the gap between the developing device and the guide member.

Effects of the Invention

According to the present invention, since the seal member is turned to a posture for opening the gap between the guide member and the developing device and a posture for blocking the toner accumulated on the guide member, with the turning of the process unit, it becomes possible to suppress the air flow generated when the sheet is conveyed to the transferring nip area and to prevent the toner accumulated on the guide member from falling.

EMBODIMENT FOR CARRYING OUT THE INVENTION

Hereinafter, with reference to the attached drawings, an image forming apparatus according to the present invention will be described.

Figure 1:
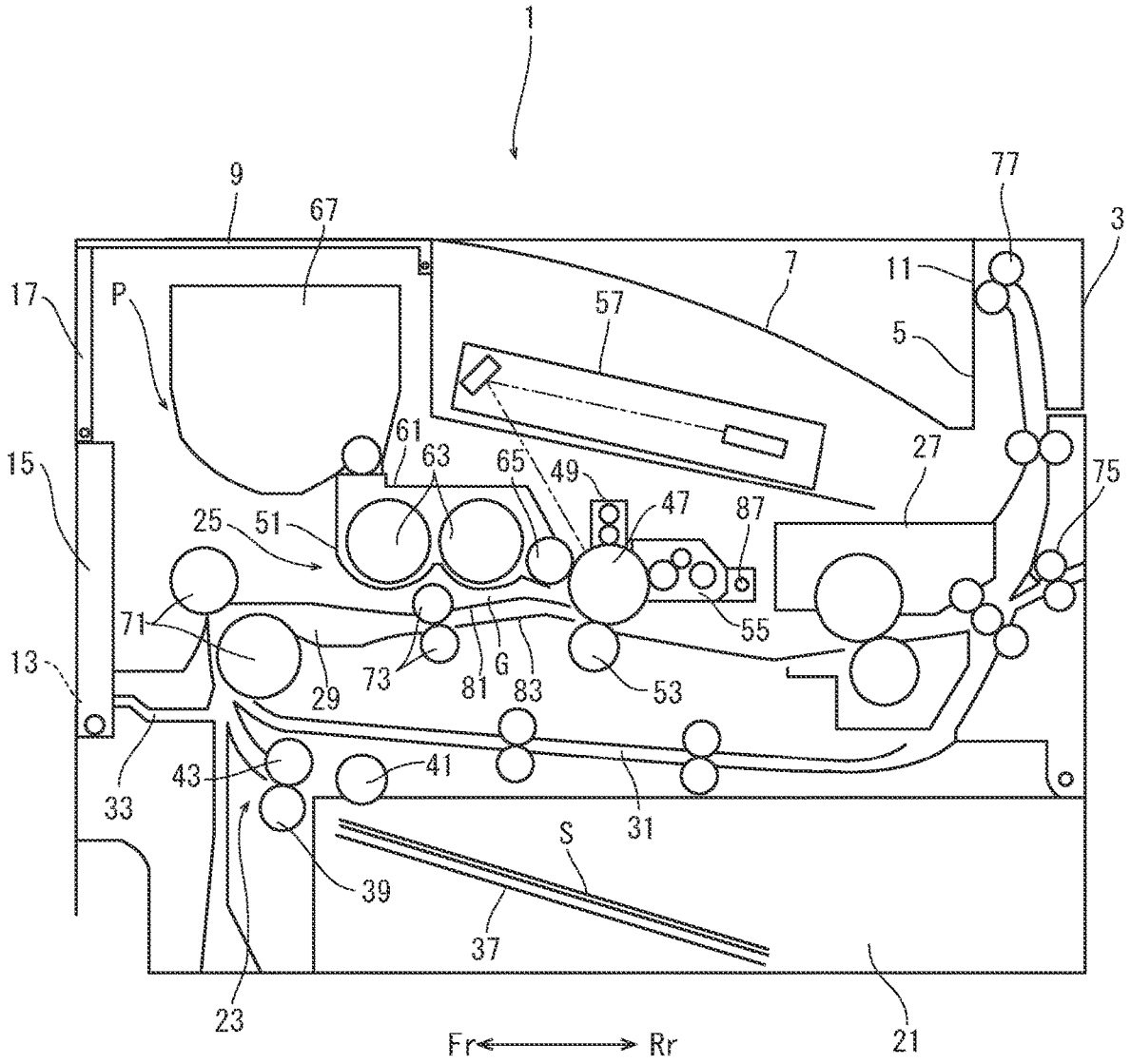
FIG. 1 is a side view schematically showing an inner structure of an image forming apparatus according to one embodiment of the present invention.

First, with reference to FIG. 1, the entire structure of the image forming apparatus will be described. FIG. 1 is a side view schematically showing the inner structure of the image forming apparatus. Hereinafter, the left side of the paper on which FIG. 1 is drawn is referred to as the front side of the image forming apparatus. Reference numerals Fr, Rr, L, and R in each drawing indicate the front, rear, left, and right sides of the image forming apparatus.

The image forming apparatus 1 includes an apparatus main body 3 having an approximately rectangular parallelepiped hollow part. On the top plate of the apparatus main body 3, a vertical rear wall 5 and a discharge tray 7 inclined upwardly from the lower end of the rear wall 5 are formed. An opening is formed on the top plate in front of the discharge tray 7. The opening is opened and closed by an upper cover 9. When the opening is opened by the upper cover 9, the hollow part of the apparatus main body 3 is exposed through the opening. A sheet discharge port 11 is formed on the upper portion of the rear wall 5.

In the lower portion of the front plate of the apparatus main body 3, a manual sheet feeding port 13 is formed. Further, a manual sheet feeding tray 15 is supported on the front plate of the apparatus main body 3 in a rotatable manner around a fulcrum below the manual sheet feeding port 13. An opening is formed in the front plate above the manual sheet feeding port 13. The opening is opened and closed by a front cover 17. When the opening is opened by the front cover 17, the hollow part of the apparatus main body 3 is exposed through the opening.

In the hollow part of the apparatus main body 3, a sheet feeding cassette 21, a sheet feeding part 23, an image forming part 25, and a fixing device 27 are housed. Further, a main conveying path 29, an inversion path 31, and a manual sheet feeding path 33 along which the sheet is conveyed are formed in the apparatus main body 3.

The sheet feeding cassette 21 is housed in the lower portion of the hollow part, and is detachable along the front-and-rear direction through the opening formed in the front plate of the apparatus main body 3. The sheet feeding cassette 21 includes a placement plate 37 on which the sheet S is placed, and a retard roller 39. The placement plate 37 is supported on the bottom plate of the sheet feeding cassette 21 so as to be turnable upward and downward around the rear end portion. The retard roller 39 is disposed in front of the placement plate 37.

The sheet feeding part 23 is disposed above the front end portion of the sheet feeding cassette 21, and includes a pickup roller 41 and a feed roller 43 arranged in front of the pickup roller 41. The pickup roller 41 is rotated in contact with the sheet S placed on the placement plate 37 turned upward, and sends the sheet S forward. The feed roller 43 comes into contact with the retard roller 39 to form a separation nip area between them.

The image forming part 25 is disposed above the sheet feeding cassette 21, and includes a photosensitive drum 47, a charger 49, a developing device 51, a transferring roller 53, a cleaning device 55, and an exposure device 57. The photosensitive drum 47 is supported so as to be rotatable in the counterclockwise direction of FIG. 1. The charger 49, the developing device 51, the transferring roller 53, and the cleaning device 55 are arranged in order along the rotating direction of the photosensitive drum 47 around the photosensitive drum 47. In this example, the charger 49 is disposed above the photosensitive drum 47, the developing device 51 is disposed on the front side pf the photosensitive drum 47, the transferring roller 53 is disposed below the photosensitive drum 47, and the cleaning device 55 is disposed on the rear side of the photosensitive drum 47.

The developing device 51 includes a developing housing 61, two agitating members 63, and a developing roller 65. The two agitating members 63 are housed in the developing housing 61 to agitate the developer. The developing roller 65 is arranged to face the photosensitive drum 47 through the opening of the developing housing 61, and forms a developing nip area between the developing roller 65 and the photosensitive drum 47. At the developing nip area, the toner moves from the developing roller 65 to the photosensitive drum 47. A toner container 67 is detachably connected to the developing housing 61.

The transferring roller 53 faces the photosensitive drum 47 from below and forms a transferring nip area between the photosensitive drum 47 and the transferring roller 53.

The fixing device 27 is disposed on the rear side of the image forming part 25, and includes a fixing roller and a pressing roller.

The main conveying path 29 is formed so as to curve upward from the separation nip area, extend rearward substantially horizontally through the transferring nip area and the fixing device 27, and curve upward from the fixing device 27 toward the discharge port 11. A direction along the main conveying path 29 is defined as a conveying direction of the sheet S, and the upstream side and the downstream side in the following description indicate the upstream side and the downstream side in the conveying direction of the sheet S. The inversion path 31 branches from the main conveying path 29 on the downstream side of the fixing device 27, and merges with the main conveying path 29 on the downstream side of the separation nip area. The manual sheet feeding path 33 merges with the main conveying path 29 on the downstream side of the separation nip area from the manual sheet feeding port 13.

On the main conveying path 29, an intermediate rollers pair 71, a registration rollers pair 73, a switchback path 75, and a discharge rollers pair 77 are provided in order from the upstream side. The intermediate rollers pair 71 is disposed on the downstream side of the junction of the inversion path 31, the manual sheet feeding path 33 and the main conveying path 29. The registration rollers pair 73 is disposed between the intermediate rollers pair 71 and the transferring nip area. The switchback path 75 is disposed on the downstream side of the fixing device 27. The discharge rollers pair 77 is disposed inside the discharge port 11.

The main conveying path 29 from the registration rollers pair 73 to the transferring nip area is formed between an upper guide member 81 and a lower guide member 83 below the developing device 51 along a substantially horizontal direction from the front side to the rear side. The upper guide member 81 is supported by the developing housing 61 of the developing device 51, and the lower guide member 83 is supported by the apparatus main body 3.

The upper guide member 81 has a width corresponding to the maximum size of the sheet and a predetermined length along the conveying direction. The lower surface of the upper guide member 81 is formed to be planner and is curved in an upward arc shape along the conveying direction.

The photosensitive drum 47, the charger 49, the developing device 51, the cleaning device 55, the toner container 67 and the upper guide member 81 are unitized as a process unit P. As described above, the charger 49 is disposed above the photosensitive drum 47, the developing device 51 and the upper guide member 81 are disposed in front of the photosensitive drum 47, and the cleaning device 55 is disposed on the rear side of the photosensitive drum 47. The process unit P has an end portion on the side of the cleaning device 55. The process unit P is positioned at a predetermined position with respect to the apparatus main body 3, and the end portion of the process unit P is turnably supported by a turning shaft 87 extending along the horizontal direction. That is, when the process unit P is attached at the predetermined position, the photosensitive drum 47 faces the transferring roller 53 to form the transferring nip area, and the upper guide member 81 faces the lower guide member 83 to form the main conveying path. Attachment/detachment of the process unit P will be described later.

Figure 2:
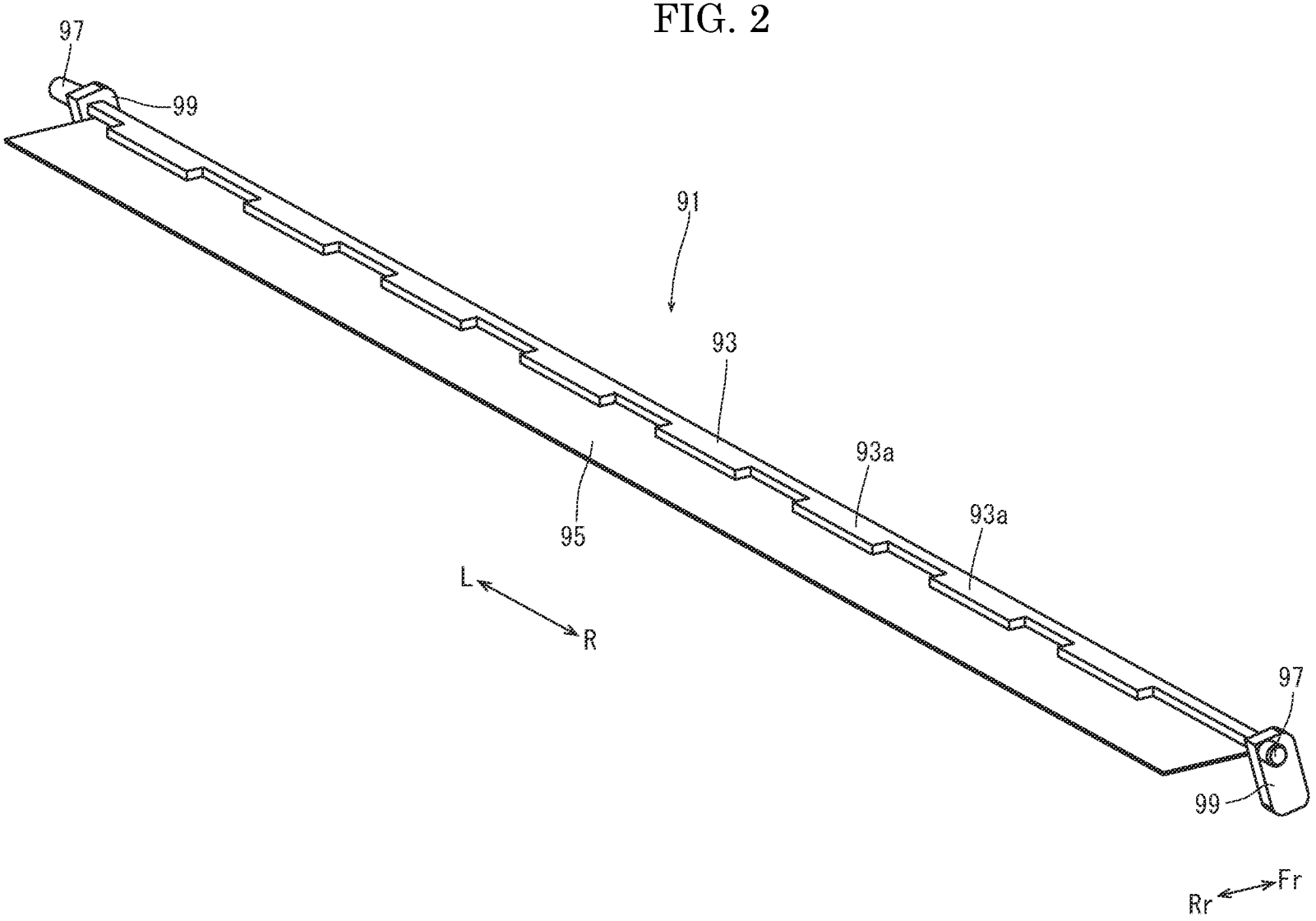
FIG. 2 is a perspective view showing a seal member of the image forming apparatus according to the embodiment of the present invention.
Figure 3:
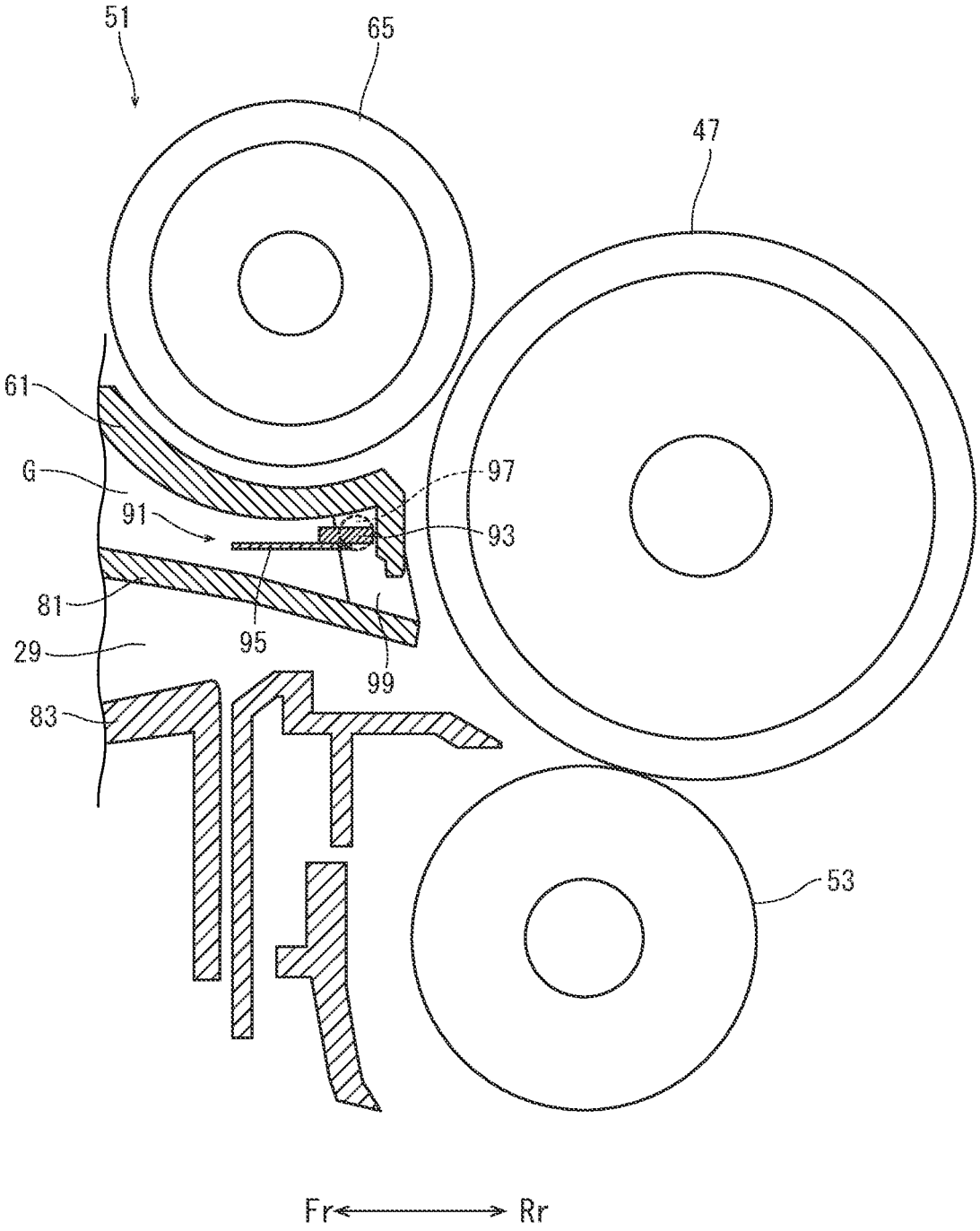
FIG. 3 is a side view showing the seal member when a process unit is attached, in the image forming apparatus according to the embodiment of the present invention.
Figure 4:
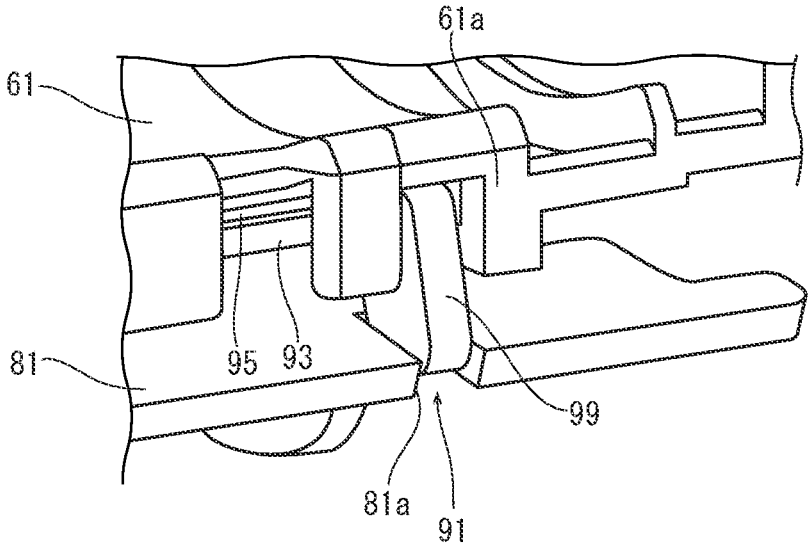
FIG. 4 is a perspective view showing an end portion of the seal member attached to a developing device, in the image forming apparatus according to the embodiment of the present invention.

A seal member 91 is provided in a gap G between the developing device 51 and the upper guide member 81. The seal member 91 will be described with reference to FIG. 2 to FIG. 4. FIG. 2 is a perspective view showing the seal member, FIG. 3 is a side view showing the seal member attached to the developing device, and FIG. 4 is a perspective view showing the end portion of the seal member attached to the developing device.

As shown in FIG. 2, the seal member 91 includes a shaft member 93, a sheet body 95 supported by the shaft member 93 in a cantilever manner, weights 99 provided at the left and right ends of the shaft member 93, and bosses 97 protruding from the outer surfaces of the weights 99.

The shaft member 93 is an elongated member having a rectangular cross section, and has a length longer than the maximum width of the sheet S. A plurality of fixing pieces 93*a* having the same thickness as that of the shaft member 93 protrude from the rear surface of the shaft member 93 at predetermined intervals in the left-and-right direction. The sheet body 95 has a rectangular shape long in the left-and-right direction, and is made of flexible material. The front end portion of the sheet body 95 is fixed to the lower surfaces of the shaft member 93 and the fixing pieces 93*a* by adhesion or the like.

Each of the two weights 99 has a rectangular parallelepiped shape long in the upper-and-lower direction, and is made of material such as resin. The right and left end surfaces of the shaft member 93 are fixed to the upper portion of the inner surfaces of the weights 99, and the weights 99 extend downward from the shaft member 93. The boss 97 protrudes from the upper portion of the outer surface of each weight 99.

As shown in FIG. 3, the seal member 91 is disposed as close as possible to the photosensitive drum 47 with a posture in which the sheet body 95 extends forward on the opposite side to the photosensitive drum 47. Both bosses 97 (see FIG. 2) are rotatably supported by shaft supporting portions 61*a* (see FIG. 4) formed on the lower surface of the developing housing 61. The left and right weights 99 are accommodated in notches 81*a* (see FIG. 4) formed in the upper guide member 81.

The seal member 91 is supported by the weights 99 such that the sheet body 95 is kept in a substantially horizontal posture. Specifically, the weight of the weights 99 is set such that the sheet body 95 is kept in a substantially horizontal posture where a force in which the fixing piece 93*a* and the sheet body 95 rotate the shaft member 93 in the counterclockwise direction of FIG. 3 is balanced by the force in which the weights 99 rotates the shaft member 93 in the clockwise direction of FIG. 3. The posture of the seal member 91 is referred to as an equilibrium posture.

In such a state that the seal member 91 is supported in the equilibrium posture, the tip end portion of the sheet body 95 is separated upward from the upper guide member 81. That is, when the process unit P is attached to the apparatus main body 3, a gap G is formed between the developing housing 61 of the developing device 51 and the upper guide member 81.

Next, an image forming operation will be described. First, the charger 49 charges the photosensitive drum 47, and the exposure device 57 exposes the photosensitive drum 47 based on image data. Thus, an electrostatic latent image is carried on the photosensitive drum 47. The developing device 51 develops the electrostatic latent image into a toner image. On the other hand, the sheet S placed on the placement plate 37 of the sheet feeding cassette 21 is fed by the pickup roller 41, and after being separated at the separation nip area, is conveyed to the main conveying path 29. Thereafter, the sheet S is conveyed by the intermediate rollers pair 71, and after the conveying timing is adjusted by the registration rollers pair 73, the sheet S is conveyed to the transferring nip area.

The upper surface of the sheet S passed through the registration rollers pair 73 is conveyed along the lower surface of the upper guide member 81, and guided from the upper guide member 81 to the photosensitive drum 47 along the curved direction of the lower surface of the upper guide member 81. At this time, the leading end of the sheet S comes into contact with the surface of the photosensitive drum 47 from the upstream side in the rotating direction of the photosensitive drum 47, and enters the transferring nip area as the photosensitive drum 47 rotates.

At the transferring nip area, the toner image carried on the photosensitive drum 47 is transferred to the sheet S. Thereafter, the sheet S is conveyed to the fixing device 27. The fixing device 27 fixes the toner image to the sheet. The sheet on which the toner image is fixed is conveyed along the main conveying path 29 toward the discharge port 11, discharged through the discharge port 11 by the discharge rollers pair 77, and stacked on the discharge tray 7. The toner remaining on the photosensitive drum 47 after the toner image is transferred to the sheet is removed by the cleaning device 55.

Figure 5A:
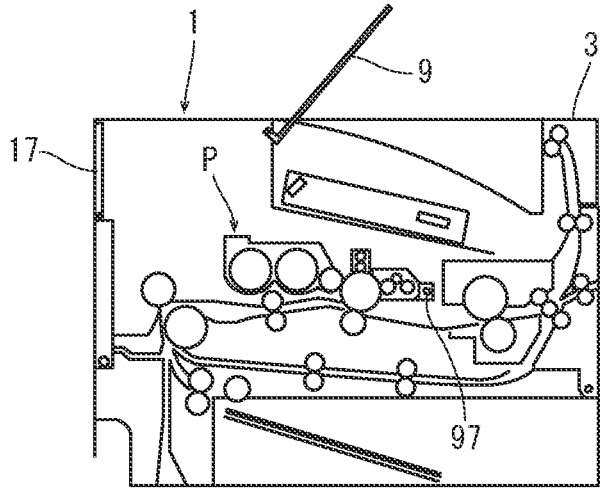
FIG. 5A is a side view schematically showing a state in which an upper cover is opened, in the image forming apparatus according to the embodiment of the present invention.
Figure 5B:
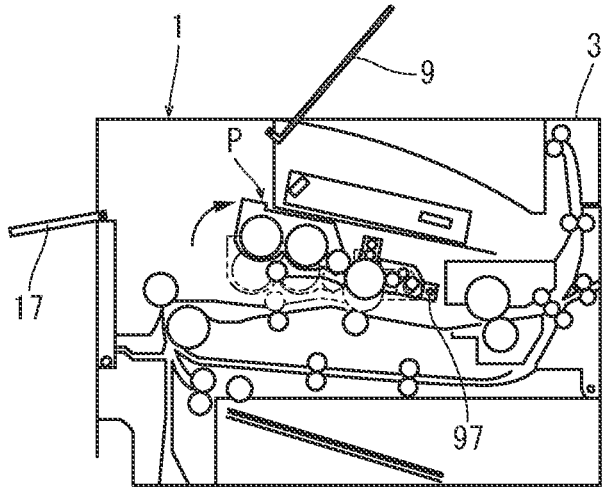
FIG. 5B is a side view schematically showing a state in which a front cover is opened and the process unit is turned, in the image forming apparatus according to the embodiment of the present invention.
Figure 5C:
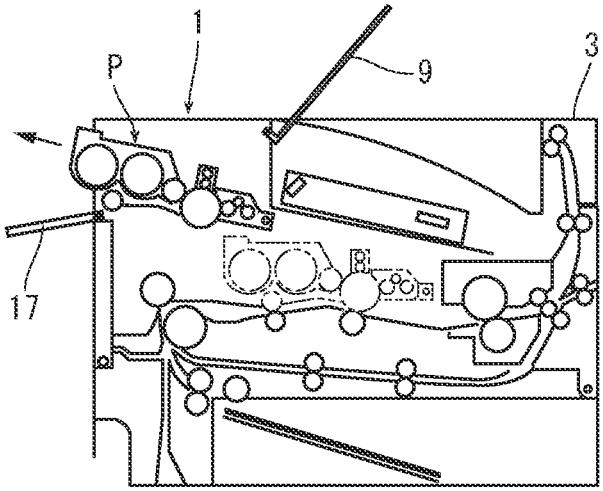
FIG. 5C is a side view schematically showing a state in which the process unit is pulled out of an apparatus main body, in the image forming apparatus according to the embodiment of the present invention.
Figure 6:
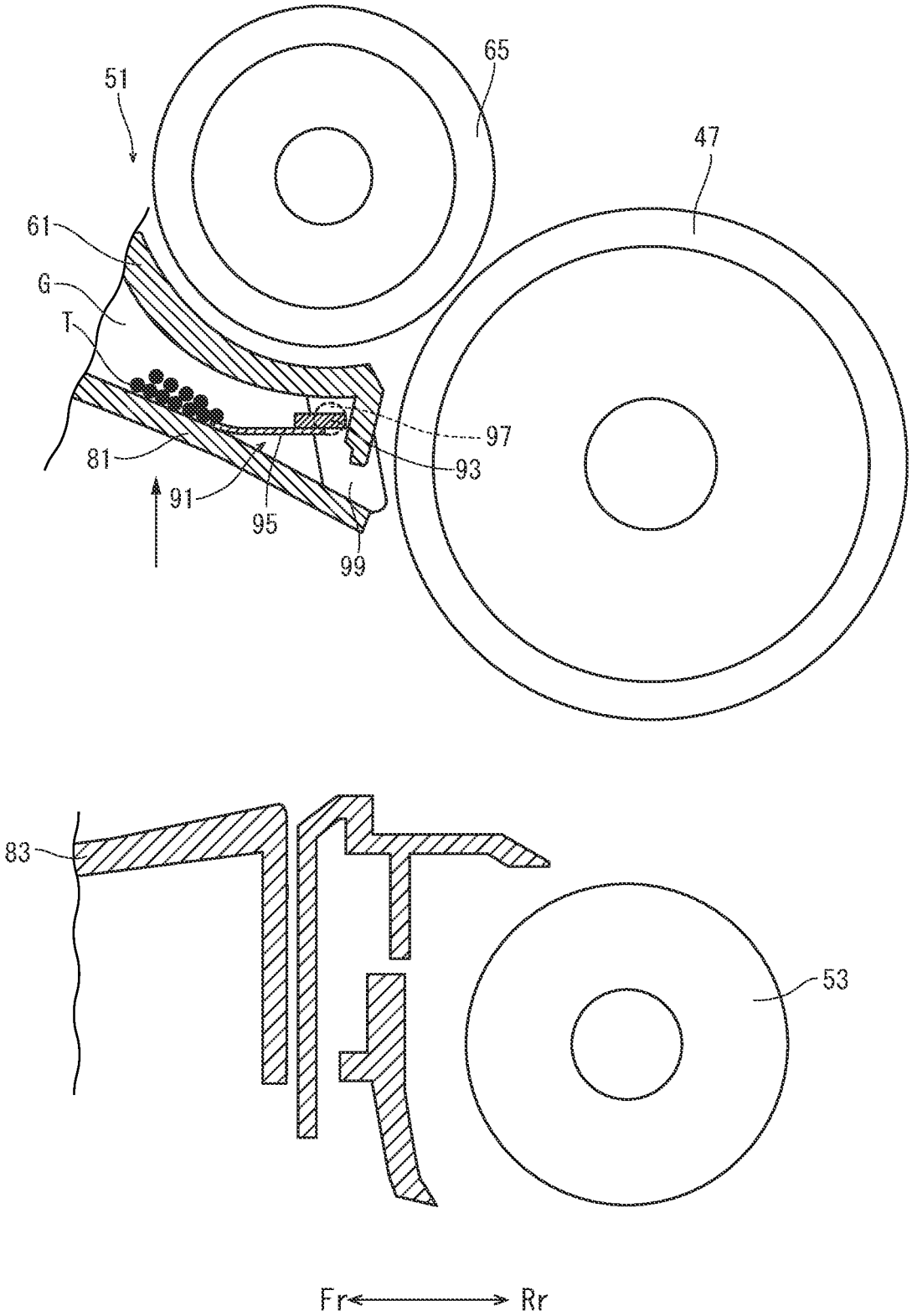
FIG. 6 is a side view showing the seal member when the process unit is turned, in the image forming apparatus according to the embodiment of the present invention.

Next, one example of the process unit P detaching method will be described with reference to FIG. 5A to FIG. 5C and FIG. 6. FIG. 5A to FIG. 5C are side views schematically explaining the image forming apparatus in which the process unit is turned. FIG. 6 is a side view showing the seal member when the process unit is turned.

When the process unit P is detached from the apparatus main body 3, as shown in FIG. 5A, the upper cover 9 is turned to open the hollow part of the apparatus main body 3. Then, the toner container 67 (see FIG. 1) is detached from the developing device 51 and pulled out through the opening of the top plate of the apparatus main body 3. Next, as shown in FIG. 6B, the front cover 17 is turned to open the hollow part, and the process unit P is turned upward around the turning shaft 87. The turning angle is 11 degrees, for example.

With the turning of the process unit P, as shown in FIG. 6, the seal member 91 is turned by its own weight in the counterclockwise direction of FIG. 6 with respect to the developing device 51, and the tip end of the sheet body 95 comes into contact with the upper guide member 81. At this time, the tip end of the sheet body 95 is slightly deformed along the upper surface of the upper guide member 81, and the seal member 91 is slightly turned in the counterclockwise direction in FIG. 6 from the equilibrium posture. When the process unit P is turned, the weights 99 does not come into contact with the upper guide member 81.

Thereafter, as shown in FIG. 5C, the process unit P is pulled out obliquely along the front and upper direction through the openings of the top plate and the front plate of the apparatus main body 3. Thus, the process unit P is detached from the apparatus main body 3.

Figure 7:
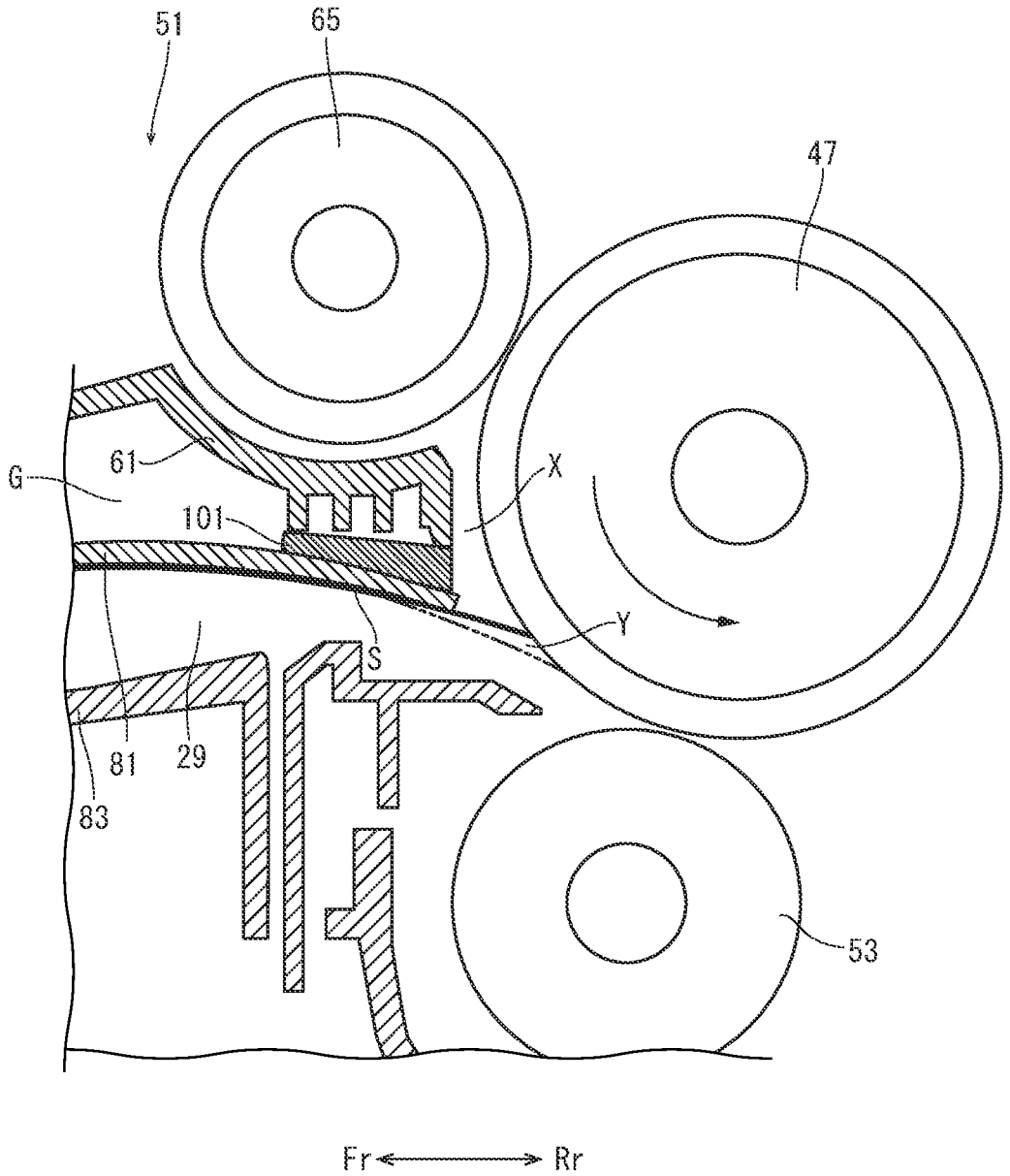
FIG. 7 prior art
FIG. 7 is a side view explaining a state in which a sheet comes into contact with a photosensitive drum as a comparative example.

With reference to FIG. 7, as a comparative example, a case will be described, in which a blocking member 101 for blocking the gap G between the developing device 51 and the upper guide member 81 is provided. In this case, when the leading end of the sheet S comes into contact with the surface of the photosensitive drum 47, a closed space X surrounded by the developing device 51 (the developing housing 61 and the developing roller 65), the blocking member 101, the upper guide member 81, the sheet S and the photosensitive drum 47 is formed. When the leading end of the sheet S moves toward the transferring nip area as the photosensitive drum 47 is rotated, the volume of the space X changes (increases) by the amount of the movement Y. When the volume of the space X changes as described above, a downwardly air flow is generated in the space X, and the position of the toner image carried on the surface of the photosensitive drum 47 is shifted downward, resulting in image defects such as transverse stripes.

On the other hand, in the present embodiment, as described above, the gap G is opened between the developing device 51 and the upper guide member 81, and the closed space as in the comparative example is not formed. Therefore, since the generation of air flow can be suppressed when the tip end of the sheet S moves toward the transferring nip area as the photosensitive drum 47 is rotated, so that no image defect is generated.

However, if the gap G is thus provided, the toner scattered through the gap G may be accumulated on the upper guide member 81. Then, if the process unit P is turned upward when the process unit P is detached from the apparatus main body 3, the toner T accumulated on the upper guide member 81 may fall through the gap G between the upper guide member 81 and the developing device 51.

However, in the present embodiment, if the process unit P is turned when the process unit P is detached from the apparatus main body 3, as shown in FIG. 6, the tip end of the sheet body 95 of the seal member 91 comes into contact with the upper guide member 81, so that the toner T accumulated on the upper guide member 81 is blocked by the sheet body 95. Therefore, the toner accumulated on the upper guide member 81 can be prevented from falling.

Further, since the seal member 91 is rotated by its own weight to a posture of opening the gap between the upper guide member 81 and the developing device 51 and a posture of bringing the sheet body 95 into contact with the upper guide member 81 as the process unit P is turned, the configuration of rotating the seal member 91 becomes unnecessary.

Although the present invention has been described in connection with certain embodiments, the present invention is not limited to the above embodiments. Those skilled in the art will be able to modify the above embodiments without departing from the scope and spirit of the invention.

The invention claimed is:

1. An image forming apparatus including a process unit which is configured to be turned upward around a turning shaft and then detached from an apparatus main body, wherein the process unit includes:

a photosensitive drum rotating in a predetermined rotating direction;

a developing device which faces a surface of the photosensitive drum to form a developing nip area;

a guide member which comes into contact with an upper surface of a sheet and guides the sheet to a downstream side of the developing nip area in the rotating direction; and a seal member supported between the developing device and the guide member in a turnable manner, wherein the seal member opens a gap between the developing device and the guide member in a state where the process unit is attached to the apparatus main body, and when the process unit is turned upward when detached from the apparatus main body, the seal member is turned to close the gap between the developing device and the guide member.

2. The image forming apparatus according to claim 1, wherein the sealing member includes:

a shaft member rotatably supported with respect to the developing device;

a weight provided so as to extend downwardly from the shaft member; and a sheet body supported by the shaft member, wherein the sheet body is supported by the weight in a posture separated from the guide member in the state where the process unit is attached to the apparatus main body, and when the process unit is turned upward when detached from the apparatus main body, the shaft member is rotated with respect to the developing device, and the sheet body comes into contact with the guide member.

3. The image forming apparatus according to claim 1, wherein a lower surface of the guide member is formed to be planar curved in an upward arc shape along the conveying direction.

4. The image forming apparatus according to claim 2, wherein the seal member is supported such that the sheet body is kept in a substantially horizontal posture in the state where the process unit is attached to the apparatus main body.

5. The image forming apparatus according to claim 1, wherein the developing device is disposed further away from the turning shaft than the photosensitive drum.

* * * * *